US010920449B1

(12) United States Patent
McDaniel

(10) Patent No.: US 10,920,449 B1
(45) Date of Patent: Feb. 16, 2021

(54) HANDLE ADAPTER FOR SLIDING GLASS DOORS

(71) Applicant: Steven George McDaniel, Indianapolis, IN (US)

(72) Inventor: Steven George McDaniel, Indianapolis, IN (US)

(73) Assignee: LUUV INC, Cape Coral, FL (US)

( * ) Notice: Subject to any disclaimer, the term of this patent is extended or adjusted under 35 U.S.C. 154(b) by 0 days.

(21) Appl. No.: 16/552,688

(22) Filed: Aug. 27, 2019

(51) Int. Cl.
*E05B 1/00* (2006.01)

(52) U.S. Cl.
CPC ..... *E05B 1/0015* (2013.01)

(58) Field of Classification Search
CPC ..... E05B 1/0053; E05B 1/0007; E05B 1/003; E05B 1/0061; E05B 1/0015; Y10T 16/459; Y10T 16/46; Y10T 16/466; Y10T 16/487; Y10T 16/506
See application file for complete search history.

(56) References Cited

U.S. PATENT DOCUMENTS 1,540,155 A * 6/1925 Wydom ..... H01M 2/1005 294/170
4,408,432 A * 10/1983 Carter ..... E05B 1/0015 293/128
4,673,625 A * 6/1987 McCartney ..... A45F 5/10 16/423
5,242,769 A * 9/1993 Cole ..... H01M 2/1005 16/423
5,402,553 A * 4/1995 Goetz ..... E05B 1/0015 16/413
5,638,576 A * 6/1997 Mutone ..... E05B 1/0053 16/413
5,727,858 A * 3/1998 Shapiro ..... A47B 95/02 312/348.6
5,832,564 A * 11/1998 Shanok ..... A47B 95/02 16/436
6,629,339 B2 * 10/2003 Pohl ..... E05B 1/0015 16/436
7,197,792 B2 * 4/2007 Moon ..... E05B 1/0015 16/412
7,431,358 B2 * 10/2008 Gomes ..... E05B 1/0053 292/336.3
7,784,208 B2 * 8/2010 Thompson ..... G09F 7/10 40/599
9,194,156 B2 * 11/2015 Simon ..... E05B 1/0069
9,216,506 B2 * 12/2015 Geiger ..... E05B 1/0053
9,752,347 B2 * 9/2017 Seitz ..... E05B 1/0015
(Continued)

*Primary Examiner* — Chuck Y Mah
(74) *Attorney, Agent, or Firm* — Dunlap Bennett & Ludwig, PLLC

(57) ABSTRACT

A handle adapter includes a sliding member, a cap, and a handle member. The sliding member includes a first slide channel and a second slide channel defined on opposing sides of the sliding member and parallel with one another. The cap includes a top cap channel, a first side cap channel, and a second side cap channel. The first side cap channel and the second side cap channel are parallel with one another and perpendicular relative to the top cap channel. The cap is aligned with the sliding member along a plane. The handle member includes a top end and a bottom end. The top end is coupled to the cap and the bottom end is coupled to the sliding member. The handle member is substantially protruding beyond the plane.

8 Claims, 4 Drawing Sheets

(56) References Cited

U.S. PATENT DOCUMENTS

| | | | | |
|---|---|---|---|---|
| 9,909,338 | B1 * | 3/2018 | Abrahams | E05B 1/0015 |
| 2001/0013186 | A1 * | 8/2001 | Malitas | G09F 23/00 40/599 |
| 2007/0090905 | A1 * | 4/2007 | Van Glabeke | H01H 36/0013 335/205 |
| 2007/0094905 | A1 * | 5/2007 | Thompson | G09F 7/00 40/599 |
| 2010/0037433 | A1 * | 2/2010 | Walker | A63B 21/4017 16/421 |
| 2011/0179603 | A1 * | 7/2011 | Edelen | A47B 95/02 16/415 |
| 2014/0230332 | A1 * | 8/2014 | Martinez Garcia | E05B 1/0015 49/353 |
| 2017/0046990 | A1 * | 2/2017 | Cummings | G09F 7/10 |
| 2019/0383055 | A1 * | 12/2019 | Miller | E05B 1/003 |
| 2020/0173191 | A1 * | 6/2020 | Fattouche | E05B 1/0061 |

* cited by examiner

HANDLE ADAPTER FOR SLIDING GLASS DOORS

BACKGROUND OF THE INVENTION

The present invention relates to sliding glass doors and, more particularly, to a handle adapter for sliding glass doors.

A sliding glass door, patio door, or doorwall is a type of sliding door in architecture and construction, is a large glass window opening in a structure that provide door access from a room to the outdoors, fresh air, and copious natural light. A sliding glass door is usually considered a single unit consisting of two panel sections, one being fixed and one a being mobile to slide open. Some of the less expensive sliding glass doors come with handles that are too small and are thereby difficult to open.

As can be seen, there is a need for a handle adapter for sliding glass doors.

SUMMARY OF THE INVENTION

In one aspect of the present invention, a handle adapter for a sliding door comprises: a sliding member comprising a first slide channel and a second slide channel defined on opposing sides of the sliding member and parallel with one another; a cap comprising a top cap channel, a first side cap channel, and a second side cap channel, wherein the first side cap channel and the second side cap channel are parallel with one another and perpendicular relative to the top cap channel, wherein the cap is aligned with the sliding member along a plane; and a handle member comprising a top end and a bottom end, wherein the top end is coupled to the cap and the bottom end is coupled to the sliding member, wherein the handle member is substantially protruding beyond the plane.

In another aspect of the present invention, a method of attaching a handle adapter to a sliding glass door handle comprises steps of: providing the handle adapter comprising: a sliding member comprising a first slide channel and a second slide channel defined on opposing sides of the sliding member and parallel with one another; a cap comprising a top cap channel, a first side cap channel, and a second side cap channel, wherein the first side cap channel and the second side cap channel are parallel with one another and perpendicular relative to the top cap channel, wherein the cap is aligned with the sliding member along a plane; and a handle member comprising a top end and a bottom end, wherein the top end is coupled to the cap and the bottom end is coupled to the sliding member, wherein the handle member is substantially protruding beyond the plane; sliding the first slide channel and the second slide channel of the sliding member from a top of the sliding glass door handle to a bottom end of the sliding glass door handle; and sliding the first side cap channel and the second side cap channel of cap over the top end of the sliding glass door handle until the top end rests within the top cap channel.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Figure 2:
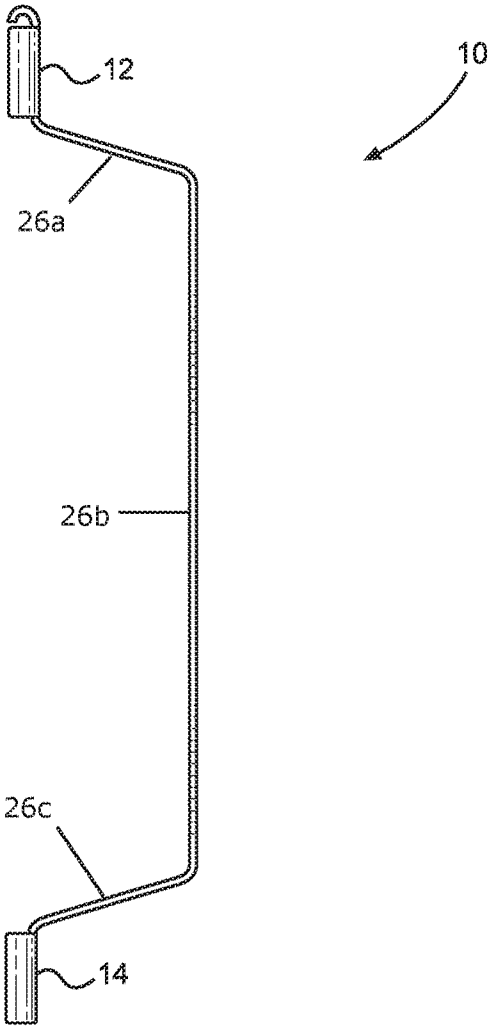
FIG. 2 is a side view of an embodiment of the present invention.
Figure 1:
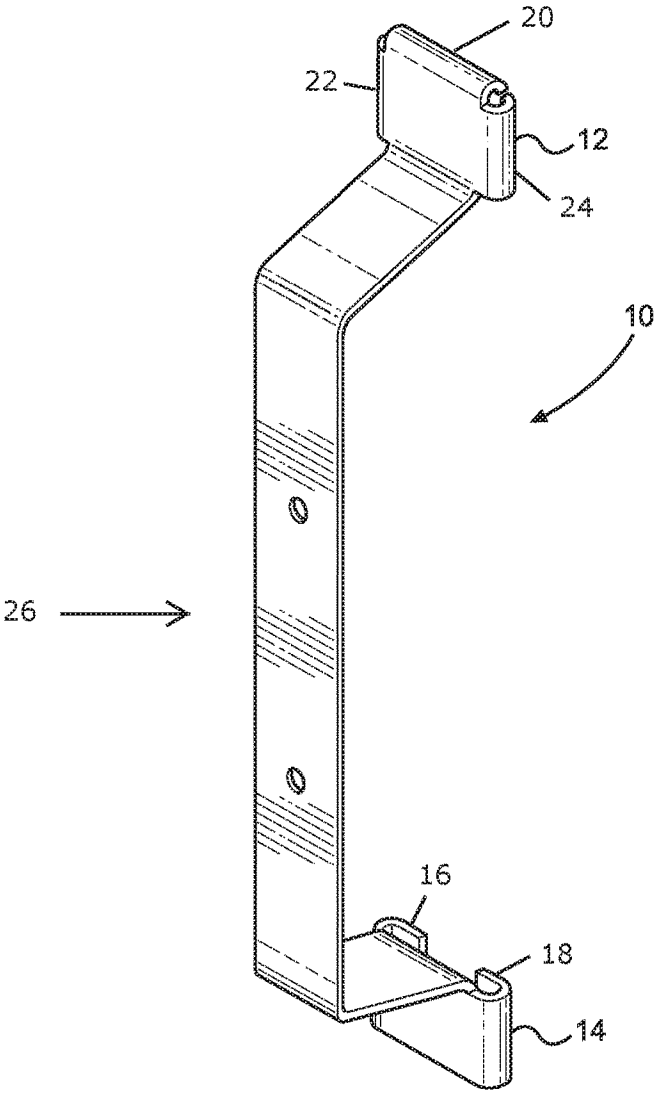
FIG. 1 is a perspective view of an embodiment of the present invention.
Figure 4:
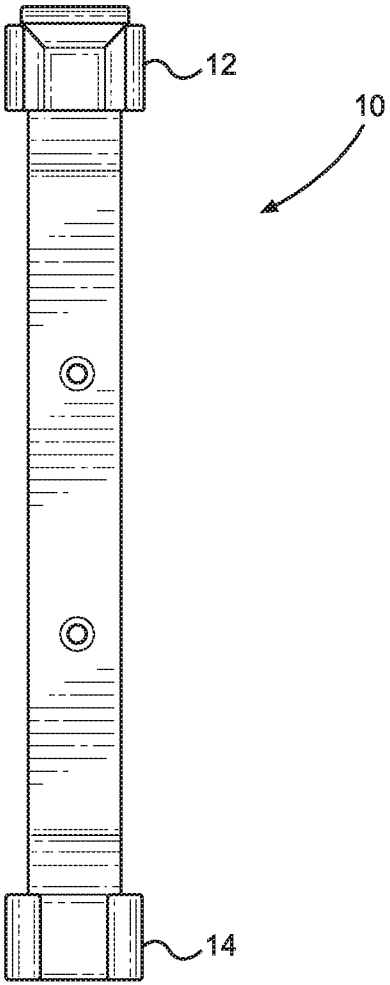
FIG. 4 is a rear view of an embodiment of the present invention.
Figure 3:
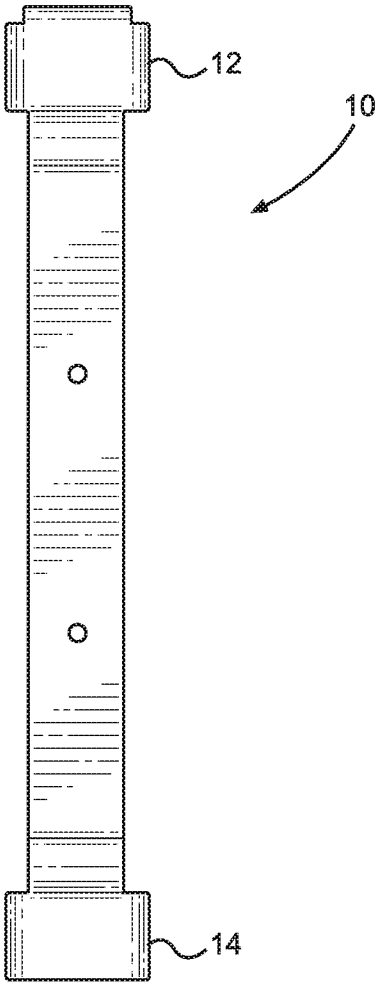
FIG. 3 is a front view of an embodiment of the present invention.
Figure 5:
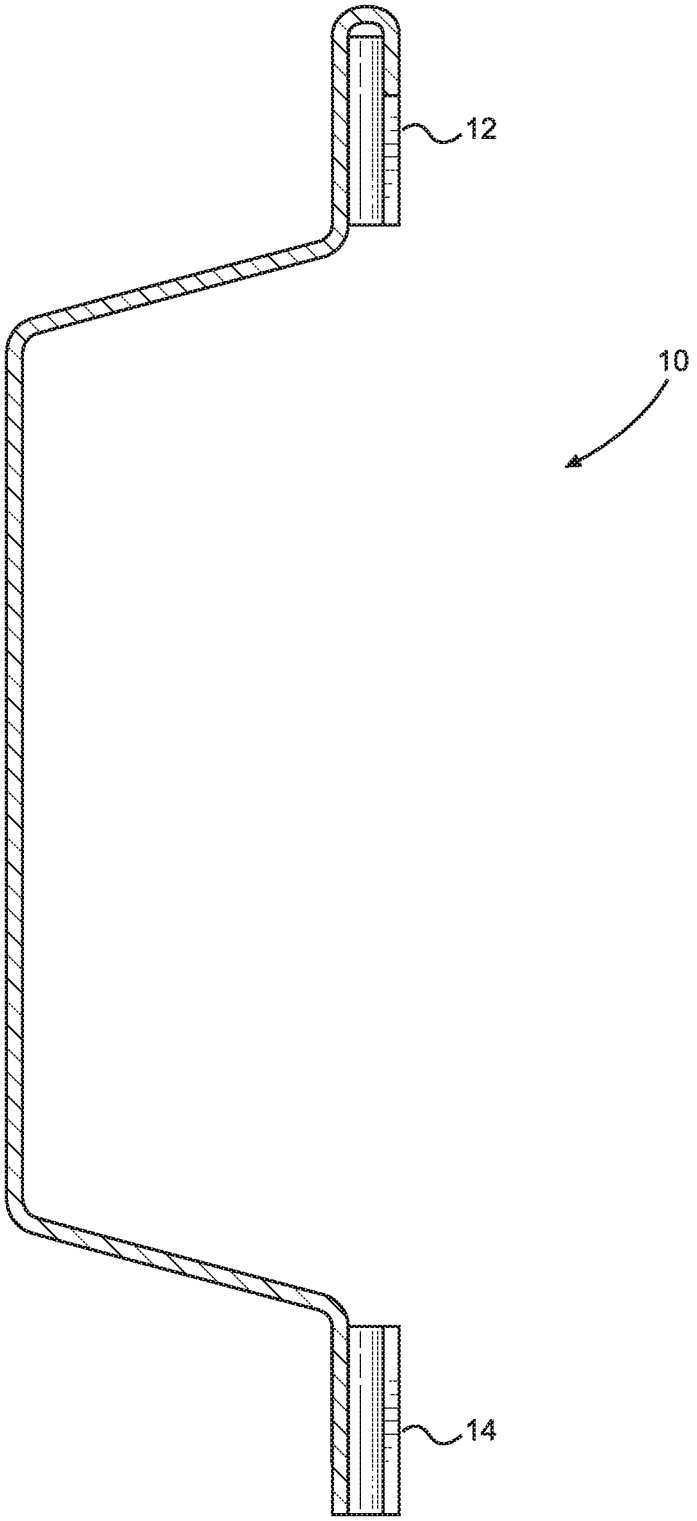
FIG. 5 is a cross-sectional view of an embodiment of the present invention.
Figure 6:
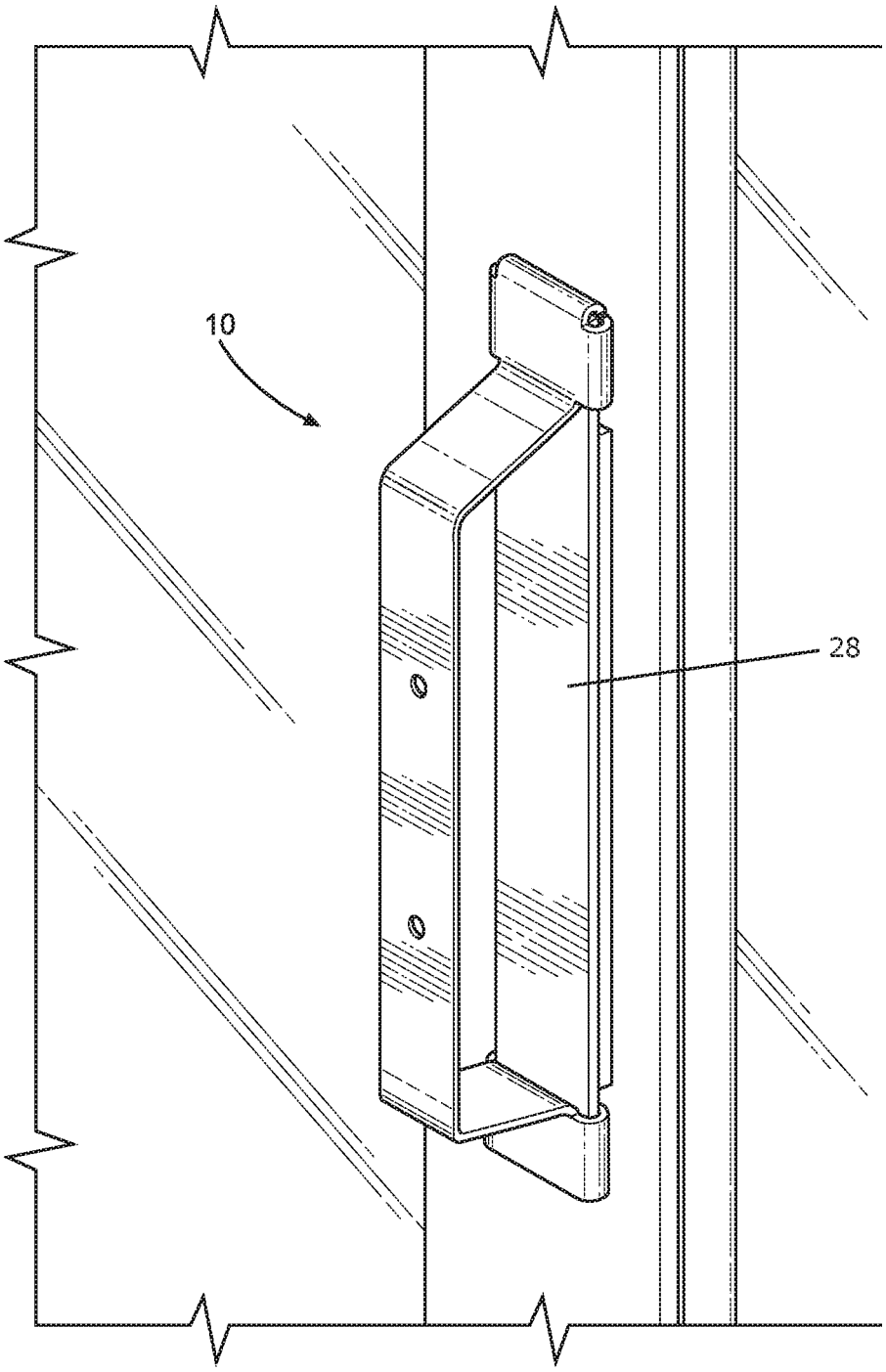
FIG. 6 is a perspective view of an embodiment of the present invention, shown in use.

Referring to FIGS. 1 through 6, the present invention includes a handle adapter 10 for a sliding door handle 28. The handle adapter 10 includes a sliding member 14, a cap 12, and a handle member 26. The sliding member 14 includes a first slide channel 16 and a second slide channel 18 defined on opposing sides of the sliding member 14 and parallel with one another. The cap 12 includes a top cap channel 20, a first side cap channel 22, and a second side cap channel 24. The first side cap channel 22 and the second side cap channel 24 are parallel with one another and perpendicular relative to the top cap channel 20. The cap 12 is aligned with the sliding member 14 along a plane. The handle member 26 includes a top end and a bottom end. The top end is coupled to the cap 12 and the bottom end is coupled to the sliding member 14. The handle member 26 is substantially protruding beyond the plane.

In certain embodiments, the handle member 26 includes a first portion 26*a*, a second portion 26*b*, and a third portion 26*c*. The first portion 26*a* extends from the cap 12 at an angle. The second portion 26*b* is joined to the first portion at a first bend in a first direction and is substantially parallel with the plane. The third portion 26*c* is joined to the second portion 26*b* at a second bend in the first direction. The third portion 26*c* extends from the sliding member 14 at the angle. The handle member 26 protrudes substantially from the cap 12 and the sliding member 14 to provide a handle that is easy to grasp.

The sliding member 14 slides over the sliding glass door handle 28 via the first slide channel 16 and the second slide channel 18. In certain embodiments, the sliding member 14 includes U-shaped tabs extending from a periphery and defining the first slide channel 16 and the second slide channel 18. The cap 12 secures over the top end of the sliding glass door handle 28. In certain embodiments, the cap 12 includes U-shaped tabs extending from a periphery and defining the top cap channel 20, the first side cap channel 22, and the second side cap channel 24.

A method of attaching a handle adapter to a sliding glass door handle may include the following steps: providing the handle adapter described above; sliding the first slide channel and the second slide channel of the sliding member from a top of the sliding glass door handle to a bottom end of the sliding glass door handle; and sliding the first side cap channel and the second side cap channel of cap over the top end of the sliding glass door handle until the top end rests within the top cap channel. The handle member protrudes outward substantially more than the handle of the sliding glass door and thereby may be used as the handle from the sliding glass door.

It should be understood, of course, that the foregoing relates to exemplary embodiments of the invention and that modifications may be made without departing from the spirit and scope of the invention as set forth in the following claims.

What is claimed is:

1. A handle adapter for a sliding door comprising:

a sliding member comprising a first slide channel and a second slide channel defined on opposing sides of the sliding member and parallel with one another;

a cap comprising a top cap channel, a first side cap channel, and a second side cap channel, wherein the first side cap channel and the second side cap channel are parallel with one another and perpendicular relative to the top cap channel, wherein the cap is aligned with the sliding member along a plane; and a handle member comprising a top end and a bottom end, wherein the top end is coupled to the cap and the bottom end is coupled to the sliding member, wherein the handle member is substantially protruding beyond the plane.

2. The handle adapter of claim 1, wherein the handle member comprises a first portion, a second portion, and a third portion, wherein the first portion extends from the cap at an angle, the second portion is joined to the first portion at a first bend in a first direction wherein the second portion is substantially parallel with the plane, and the third portion is joined to the second portion at a second bend in the first direction, wherein the third portion extends from the sliding member at the angle.

3. The handle adapter of claim 1, wherein sliding member comprises U-shaped tabs extending from a periphery and defining the first slide channel and the second slide channel.

4. The handle adapter of claim 1, wherein the cap comprises U-shaped tabs extending from a periphery and defining the top cap channel, the first side cap channel, and the second side cap channel.

5. A method of attaching a handle adapter to a sliding glass door handle comprising steps of:

providing the handle adapter comprising:

a sliding member comprising a first slide channel and a second slide channel defined on opposing sides of the sliding member and parallel with one another;

a cap comprising a top cap channel, a first side cap channel, and a second side cap channel, wherein the first side cap channel and the second side cap channel are parallel with one another and perpendicular relative to the top cap channel, wherein the cap is aligned with the sliding member along a plane; and a handle member comprising a top end and a bottom end, wherein the top end is coupled to the cap and the bottom end is coupled to the sliding member, wherein the handle member is substantially protruding beyond the plane;

sliding the first slide channel and the second slide channel of the sliding member from a top of the sliding glass door handle to a bottom end of the sliding glass door handle; and sliding the first side cap channel and the second side cap channel of cap over the top end of the sliding glass door handle until the top end rests within the top cap channel.

6. The method of claim 5, wherein the handle member comprises a first portion, a second portion, and a third portion, wherein the first portion extends from the cap at an angle, the second portion is joined to the first portion at a first bend in a first direction wherein the second portion is substantially parallel with the plane, and the third portion is joined to the second portion at a second bend in the first direction, wherein the third portion extends from the sliding member at the angle.

7. The method of claim 5, wherein sliding member comprises U-shaped tabs extending from a periphery and defining the first slide channel and the second side channel.

8. The method of claim 5, wherein the cap comprises U-shaped tabs extending from a periphery and defining the top cap channel, the first side cap channel, and the second side cap channel.

* * * * *